US006511073B2

(12) United States Patent
Simonds

(10) Patent No.: US 6,511,073 B2
(45) Date of Patent: Jan. 28, 2003

(54) GAMES AND TOYS

(76) Inventor: Colin Duncan Simonds, 7 Chesterfield Road, London (GB), W4 3HG ( * ) Notice: Subject to any disclaimer, the term of this patent is extended or adjusted under 35 U.S.C. 154(b) by 0 days.

(21) Appl. No.: 09/987,428

(22) Filed: Nov. 14, 2001

(65) Prior Publication Data

US 2002/0056964 A1 May 16, 2002

(30) Foreign Application Priority Data

Nov. 14, 2000 (GB) ..... 0027720
May 30, 2001 (GB) ..... 0113081

(51) Int. Cl.[7] ..... A63F 9/00; A63H 33/08

(52) U.S. Cl. ..... 273/299; 273/156; 446/106; 446/122; 446/124; 446/85

(58) Field of Search ..... 273/306, 299, 273/444, 271, 288; 446/124, 125, 85, 106, 107, 108, 117, 118, 119, 120, 121, 122; 434/159, 160, 167, 171, 172, 173, 174, 175, 176

(56) References Cited

U.S. PATENT DOCUMENTS 1,531,542 A * 3/1925 Cogshall ..... 273/157 R
2,972,833 A * 2/1961 Grutta ..... 446/110
4,690,410 A * 9/1987 Berton ..... 273/294
5,186,672 A 2/1993 Tung ..... 446/95
5,702,105 A * 12/1997 Glikmann ..... 273/156
5,799,943 A * 9/1998 Morgan ..... 273/160
5,938,497 A * 8/1999 Mott ..... 446/122

FOREIGN PATENT DOCUMENTS

| | | |
|---|---|---|
| GB | 484259 | 5/1938 |
| GB | 2302662 A | 1/1997 |
| WO | WO86/04253 | 7/1986 |
| WO | WO93/17767 | 9/1993 |

* cited by examiner

*Primary Examiner*—S. Thomas Hughes
*Assistant Examiner*—Alex F. R. P. Rada, II
(74) *Attorney, Agent, or Firm*—Jacobson Holman PLLC

(57) ABSTRACT

A game or toy comprises a plurality of rectangular elements each having a substantially square upper face and a substantially square lower face interconnected by four rectangular side faces. The upper face of each element has an alphanumeric character printed on it or molded onto or into it. The side faces of each element are dimensioned so that the elements are free-standing on any side face. Two adjacent side faces of each element have projecting half star shaped connectors means formed on them, while the other two adjacent side faces have complementary grooves shaped to receive and retain the retain the projecting connectors of another such element, so that the elements can be joined together side face to side face in two mutually perpendicular direction to form a two dimensional crossword or number game. Auxiliary connecting elements are provided for connecting the rectangular elements together with their upper faces at right angles, so that the game can be played in three dimensions.

8 Claims, 2 Drawing Sheets

GAMES AND TOYS

This invention relates to games and toys, and is more particularly concerned with games and toys in which individual pieces make up crosswords or number games.

A number of different crossword games are known in the prior art. One of the more well known of these prior art games comprises a multiplicity of rectangular tiles, each having a respective letter of the alphabet on one face. This well known game also comprises a rectangular board divided into squares whose size corresponds to that of the tiles, these squares forming a rectangular grid. During play, the lettered tiles are laid out on the squares on the board, to make up words which intersect each other to form a crossword.

In this particular well known crossword game, the individual tiles are flat, and can therefore move about on the board if the board is jogged, thus creating confusion as to where they were originally laid. Also, each player needs to be provided with a tile rest, which supports the tiles so that they face the player who has received them, while concealing them from the other players. The game thus requires various extra components in addition to the tiles themselves, namely the board and the tile rests.

A number of different constructional toys also exist in the prior art, such toys typically comprising generally rectangular brick-like building elements which can be connected together to build a variety of two and three dimensional structures. A particularly advantageous example of such a constructional toy is described in United Kingdom Patent No. 2,302,662.

It is an object of the present invention to provided a novel game or toy which in its preferred implementations overcomes some of the drawbacks of the well known prior art crossword game.

According to the present invention, there is provided a game or toy comprising a plurality of rectangular elements each having a substantially square upper face and a substantially square lower face interconnected by four rectangular side faces, the upper face having an alphanumeric character thereon, the side faces being dimensioned so that the element is free-standing on any one of them, two adjacent side faces having projecting connecting means formed thereon, and the other two adjacent side faces having recessed connecting means shaped to receive and retain the projecting connecting means of another such element, whereby the elements can be joined together side face to side face in two mutually perpendicular directions to form a crossword or a number game, in dependence upon whether said alphanumeric characters are letters or numbers, said connecting means being adapted for tight frictional engagement such that large assemblies of joined-together elements can be picked up and moved without said elements becoming disengaged.

It will be appreciated that because the elements are free-standing on their side faces, and can be joined together side face to side face, no other components (a board, element rests) are required when the elements are used to play a crossword or number game, and there is therefore no limit (other than the number of elements available) to the size of the crossword or number game that can be formed. Additionally, because the connecting means are formed as integral parts of the elements themselves, the game or toy of the present invention is safe for use in homes, schools or other premises where very young children may be present. And in the limit, the elements can if desired be used to build two dimensional structures similar to some of those which can be built with the constructional toy of United Kingdom Patent No. 2,302,662, or, if appropriately shaped and dimensioned, can be used in combination with the building blocks of that constructional toy.

In a preferred implementation of the invention, each connecting means extends substantially perpendicularly to the upper and lower faces of the element along the middle of its side face. In this case, the projecting connecting means preferably has a cross sectional shape like that of a bisected star having 2N equiangularly spaced points, where N is at least 2, i.e. a form corresponding to the portion of one of the star shaped connecting elements of United Kingdom Patent No. 2,302,662 which projects from the mouth of its groove in a main element of that patent, while the recessed connecting means preferably comprises a complementarily-shaped groove, i.e. like those in the main elements of that patent.

More generally, the recessed connecting means comprises a groove shaped to receive and entrap the projecting connecting means.

Preferably, the elements are all hollow, with said lower face open.

The alphanumeric characters may be printed on the upper faces of their respective elements. Alternatively and preferably, the alphanumeric characters are moulded into or onto the upper faces of their respective elements.

The game or toy advantageously also includes auxiliary connecting elements adapted to co-operate with the recessed connecting means of the rectangular elements so as to connect together two rectangular elements with their upper faces at right angles to each other, whereby said crossword or number game can be played in three dimensions.

Advantageously, each auxiliary connecting element comprises first and second elongate members each having a cross sectional shape substantially identical to that of the projecting connecting means of the rectangular elements, said members each having a flat side and being integrally joined together at right angles to each other and at the respective midpoints of their respective flat sides.

Conveniently, all the elements are moulded in a suitable plastics material, such as ABS, acrylic plastic, polystyrene or polypropylene.

The invention will now be described, by way of example only, with reference to the accompanying drawings, of which:

Figure 1:
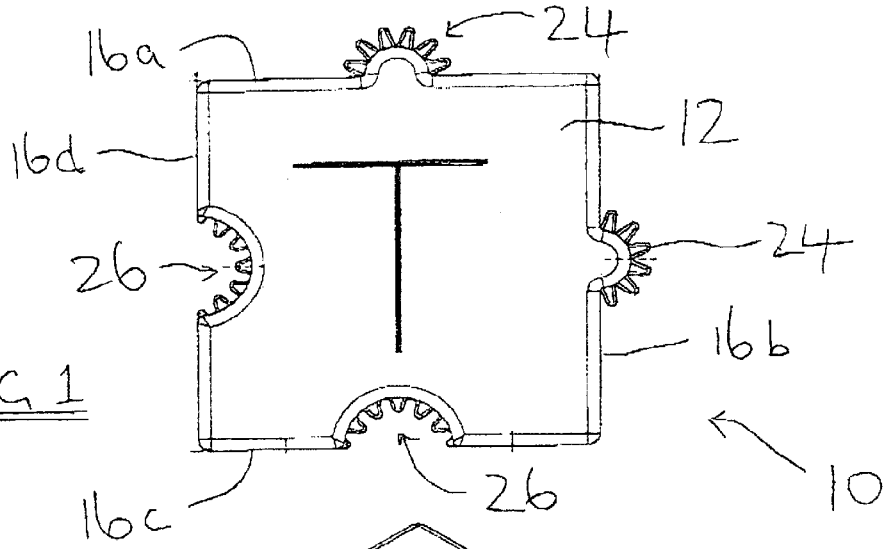
FIG. 1 is top view of a rectangular element forming part of a crossword game in accordance with the present invention.
Figure 2:
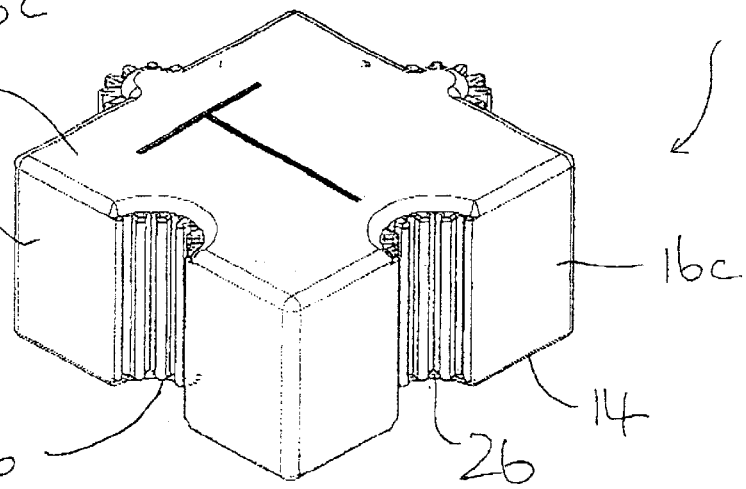
FIG. 2 is a perspective view from above of the rectangular element of FIG. 1.
Figure 3:
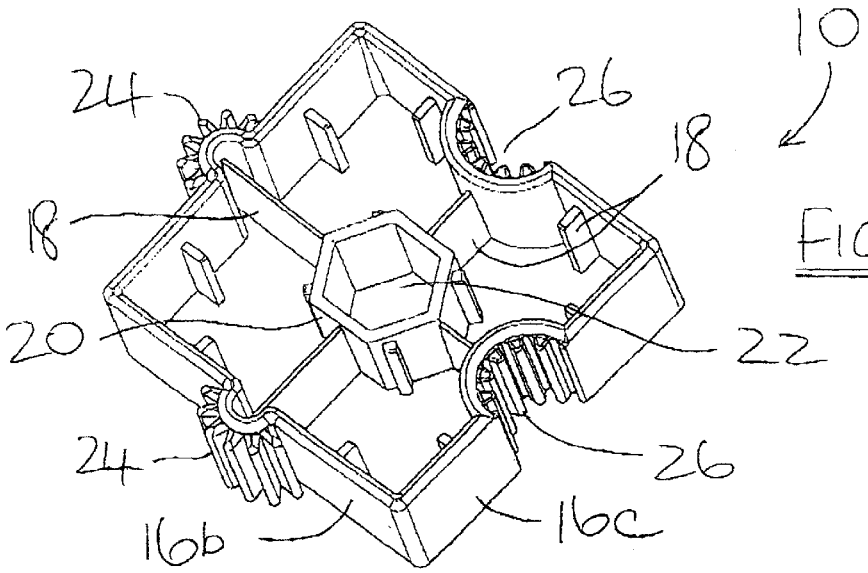
FIG. 3 is a perspective view from beneath of the element of FIG. 1.

The crossword game of the present invention comprises a plurality of hollow rectangular elements, one of which is indicated at 10 in FIGS. 1 to 3.

Each rectangular element 10 is similar in a number of ways to the hollow square-section main building blocks of United Kingdom Patent No 2,302,662. In particular, each element 10 is moulded in a suitable coloured plastics material such as ABS, acrylic plastic, polystyrene or polypropylene, and has substantially square upper and lower faces 12, 14 respectively, typically about 30 cm by 30 cm. The upper face 12 is substantially flat and closed, while the lower face is substantially flat and open. The upper and lower faces 12, 14 are interconnected by four identically-sized rectangular side faces 16*a* to 16*d* perpendicular to the upper and lower faces, each side face 16 being typically about 30 cm by 20 cm. The area of each of the side faces is thus sufficiently large that the element 10 is free-standing in a stable manner on any one of them.

As best seen in FIG. 3, the interior of the rectangular element 10 has several integral stiffening ribs 18 moulded in it between the side faces 16 and an internal hexagonal wall 20 defining a centrally positioned blind aperture 22. However, the blind aperture is optional, and can be omitted if desired.

In accordance with the present invention, each of the rectangular elements 10 has a letter of the alphabet printed on, or moulded into or onto, its upper face 12: as an example, the rectangular element 10 of FIGS. 1 and 2 has the letter T on it.

The elements 10 can be joined together side face 16 to side face 16 in a manner analogous to that in which the square and triangular building blocks of United Kingdom Patent No 2,302,662 are joined together, but with one important difference: the connecting means for the elements 10 is integral with the elements themselves.

Thus each of the two adjacent side faces 16*a* and 16*b* of the element 10 is provided with a moulded projecting connector 24, which extends perpendicularly between the upper and lower faces 12, 14 along the middle of the side face. The cross sectional shape of the connectors 24 is like that of a bisected star having twelve equiangularly spaced points, i.e. it has a form corresponding to the portion of one of the star shaped connecting elements of United Kingdom Patent No. 2,302,662 which projects from the mouth of its groove in one of the square or triangular main building block of that patent. Each of the other two side faces 16*c* and 16*d* is provided with a groove 26, which is complementary in cross sectional shape to the connectors 24, i.e. it is substantially identical to the grooves in the side faces of the square or triangular main building block of the aforementioned patent.

Figure 4:
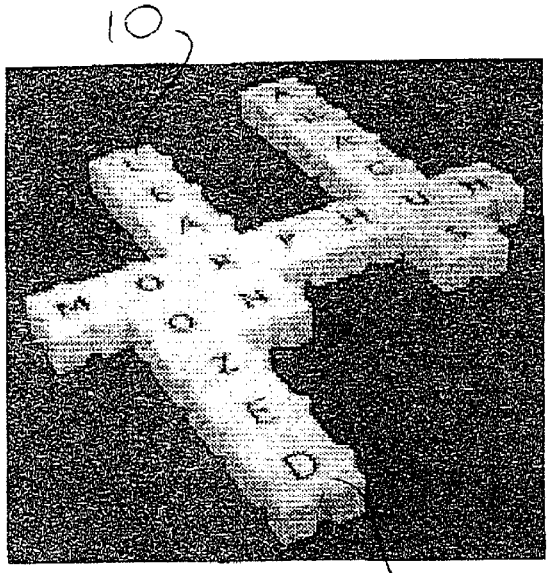
FIG. 4 shows a two dimensional crossword formed with the rectangular elements of FIGS. 1 to 3.

To play the crossword game, each player takes or is given a random selection of the rectangular elements 10, with a variety of letters of the alphabet on them. The individual elements 10 of this selection can be stood on their side faces 16 so as to face the player, and so that they cannot be seen by the other player or players. The players then try to make up words with the letters on their elements 10, and join the relevant elements together to form the words on any convenient flat surface, by means of the connectors 24, 26. Since the connectors 24, 26 permit interconnection of the elements 10 in two mutually perpendicular directions, intersecting words can be formed to make up a crossword, a typical example of which is shown in FIG. 4.

By virtue of the shape of the connectors 24, 26, the rectangular elements 10 fit together quite tightly, so that jogging one of the words formed from the elements is not likely to cause the elements to separate. No board is required, since any convenient flat surface can be used, and because the elements are free-standing on their side faces 16, no means of supporting them (other than the flat surface) is required. Also, the whole crossword game can be picked up during a game and moved, eg for temporary storage, so that play can recommence later. And as already mentioned, there is no limit (other than the number of elements available) to the size of the crossword that can be formed.

Additionally, the size of the rectangular elements 10 and the fact that the connectors 24, 26 are integral with them makes them safe for use by (or in the presence on young children, as an early learning aid for teaching spelling. And the fact that the integral connectors 24, 26 are in the same position on each element means that there is no ambiguity in the orientation of certain letters, eg M and W, that requires underlining to avoid confusion.

It will be appreciated that the crossword game described with reference to FIGS. 1 to 4 is a two dimensional game. However, by the addition of auxiliary connecting elements as shown in FIGS. 5A to 5C, the crossword game of the invention can be converted into a three dimensional version.

Figures 5A, 5B:
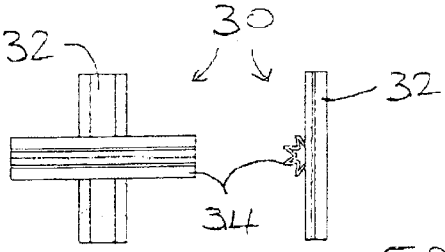
FIGS. 5A to 5C show several different views of an auxiliary connecting element for converting the two dimensional crossword game of FIGS. 1 to 3 into a three dimensional embodiment.
Figure 5C:
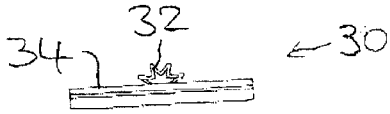

Thus the auxiliary connecting element of FIGS. 5A to 5C is indicated at 30, and comprises first and second elongate members 32,34 each having a cross sectional shape substantially identical to that of the projecting connectors 24 of the rectangular elements 10 of FIGS. 1 to 3. The members 32, 34 therefore each have a flat side (corresponding to the side face 16*a* or 16*b* of the element 10 from which the connector 24 projects), and they are integrally joined together at right angles to each other and at the respective midpoints of their respective flat sides.

Figure 6:
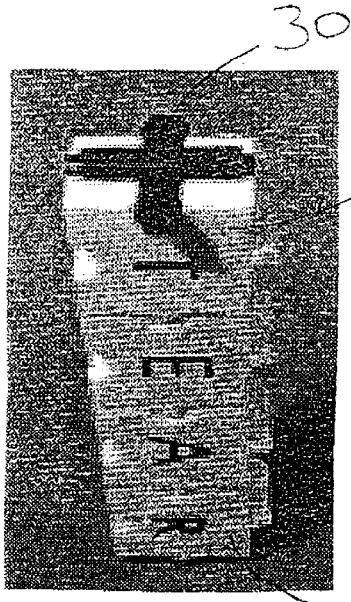
FIG. 6 illustrates how the auxiliary connecting element of FIGS. 5A to 5C is used.
Figure 7:
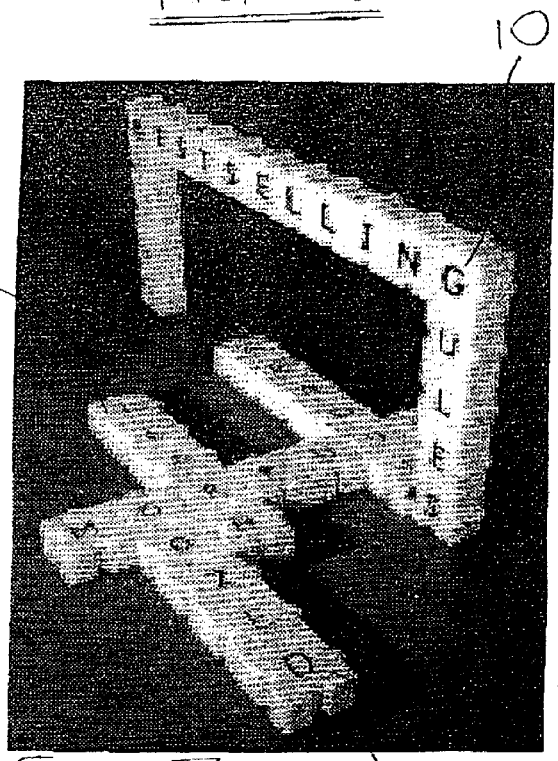
FIG. 7 shows some three dimensional crosswords formed with the rectangular elements of FIGS. 1 to 3 and the auxiliary connecting elements of FIGS. 5A to 5C.

By inserting one member 32 into a groove 26 in one rectangular element 10, as shown in FIG. 6, and the other member 34 into a groove 26 in another rectangular element 10, the two rectangular elements 10 can be joined together with their respective upper faces 12 at right angles to each other. It is this that permits three dimensional crosswords to be formed, and typical examples of such crosswords are illustrated in FIG. 7.

Although the invention has been described as being implemented as a crossword game, by replacing the letters with numbers, it can be used to form a number game.

Many modifications can be made to the described embodiment of the invention. In particular, the integral connectors 24, 26 can be based on star shapes having less than twelve points: in the limit, they can be based on star shapes having 2N points, where N is two or more. Alternatively, they can be based on dovetail-type interlocking.

Finally, the elements 10 can be sized to be compatible with, i.e. fit with, the square and triangular building blocks of the constructional toy of United Kingdom Patent No 2,302,662, in which case they can additionally be used as extra building blocks for that toy (or blocks of that toy can be incorporated into the crosswords or number games of the present invention, eg as blanks). Or the elements 10 can simply be used on their own as a constructional toy.

What is claimed is:

1. A game or toy comprising a plurality of rectangular elements each having a substantially square upper face and a substantially square lower face interconnected by four rectangular side faces, the upper face having an alphanumeric character thereon, two adjacent side faces having projecting connecting means formed thereon, and the other two adjacent side faces having recessed connecting means shaped to receive and retain the projecting connecting means of another such element for joining the elements together side face to side face in two mutually perpendicular directions to form a crossword or a number game, in dependence upon whether said alphanumeric characters are letters or numbers, said connecting means being adapted for tight frictional engagement such that large assemblies of joined-together elements can be picked up and moved without said elements becoming disengaged, said each connecting means extends along said side face substantially perpendicular to the upper and lower faces of the element and extends along a middle of said side face, auxiliary connecting elements cooperate with said recessed connecting means of the rectangular elements so as to connect together two rectangular elements with their upper faces at right angles to each other, each said auxiliary connecting element includes first and second elongate members each having a cross sectional shape substantially identical to that of the projecting connecting means of the rectangular elements, and said members each having a flat side and being integrally joined together at right angles to each other and at respective midpoints of their respective flat sides.

2. The game or toy as claimed in claim 1, wherein the projecting connecting means has a cross sectional shape like that of a bisected star having 2N equiangularly spaced points, while the recessed connecting means comprises a complementarily-shaped groove.

3. The game or toy as claimed in claim 1, wherein the recessed connecting means comprises a groove shaped to receive and entrap the projecting connecting means.

4. The game or toy as claimed in claim 1, wherein the alphanumeric characters are printed on the upper faces of their respective elements.

5. The game or toy as claimed in claim 1, wherein the alphanumeric characters are molded into or onto the upper faces of their respective elements.

6. The game or toy as claimed in claim 1, wherein the rectangular elements are all hollow, with said lower face open.

7. The game or toy as claimed in claim 1, wherein all the elements are molded in a suitable plastics material.

8. The game or toy as claimed in claim 7, wherein said suitable plastics material is selected from the group concisting of ABS acrylic plastic, polystyrene and polypropylene.

* * * * *